US007468231B2

(12) United States Patent
Lin et al.

(10) Patent No.: US 7,468,231 B2
(45) **Date of Patent: *Dec. 23, 2008**

(54) IMAGING MEMBERS

(75) Inventors: Liang-Bih Lin, Rochester, NY (US); Jin Wu, Webster, NY (US); John S. Chambers, Rochester, NY (US); Francisco J. Lopez, Rochester, NY (US)

(73) Assignee: Xerox Corporation, Norwalk, CT (US)

( * ) Notice: Subject to any disclaimer, the term of this patent is extended or adjusted under 35 U.S.C. 154(b) by 458 days.

This patent is subject to a terminal disclaimer.

(21) Appl. No.: 11/054,045

(22) Filed: Feb. 9, 2005

(65) Prior Publication Data

US 2006/0177751 A1 Aug. 10, 2006

(51) Int. Cl.
*G03G 5/04* (2006.01)

(52) U.S. Cl. ..... 430/75; 430/56; 430/59.6; 430/96

(58) Field of Classification Search ..... 430/56, 430/75, 96

See application file for complete search history.

(56) References Cited

U.S. PATENT DOCUMENTS

| | | | | |
|---|---|---|---|---|
| 3,121,006 | A | 2/1964 | Middleton | |
| 4,286,033 | A | 8/1981 | Neyhart | 430/58.6 |
| 4,291,110 | A | 9/1981 | Lee | 430/58.6 |
| 4,298,697 | A | 11/1981 | Baczek | 521/27 |
| 4,338,387 | A | 7/1982 | Hewitt | 430/57.8 |
| 4,338,390 | A | 7/1982 | Lu | 430/108.2 |
| 4,515,882 | A | 5/1985 | Mammino | 430/58.45 |
| 4,560,635 | A | 12/1985 | Hoffend | 430/108.2 |
| 5,336,577 | A | 8/1994 | Spiewak | 430/58.25 |
| 5,370,953 | A | 12/1994 | Nakatani | 430/58.05 |
| 5,484,867 | A | 1/1996 | Lichtenhan et al. | 528/9 |
| 5,601,958 | A * | 2/1997 | Kato et al. | 430/49.31 |
| 5,700,614 | A | 12/1997 | Kawahara | 430/58.35 |
| 5,968,696 | A | 10/1999 | Yoshida | 430/78 |
| 6,015,869 | A * | 1/2000 | Grate et al. | 528/15 |
| 6,277,451 | B1 * | 8/2001 | Mehl et al. | 428/1.1 |
| 6,656,650 | B1 | 12/2003 | Lin | 430/56 |
| 6,677,909 | B2 | 1/2004 | Sun | 343/767 |
| 6,787,277 | B2 | 9/2004 | Tong | 430/58.8 |
| 6,824,940 | B2 | 11/2004 | Wu | 430/66 |
| 2003/0152855 | A1 * | 8/2003 | Drappel et al. | 430/60 |
| 2003/0211413 | A1 * | 11/2003 | Lin et al. | 430/78 |
| 2004/0185357 | A1 * | 9/2004 | Azuma et al. | 430/58.05 |
| 2005/0136348 | A1 * | 6/2005 | Wu et al. | 430/56 |
| 2006/0029873 | A1 * | 2/2006 | Bender et al. | 430/59.6 |
| 2006/0177748 | A1 * | 8/2006 | Wu et al. | 430/58.2 |

OTHER PUBLICATIONS

HTTP://www.HYBRID PLASTICS.COM, "What is POSS Technology?", 2 pages. Feb. 11, 2008.

(Continued)

*Primary Examiner*—Mark F Huff
*Assistant Examiner*—Rachel L Burney
(74) *Attorney, Agent, or Firm*—Marylou J. Lavole, Esq. LLC

(57) ABSTRACT

An imaging member comprising a supporting substrate; a single layer photoreceptor for both charge generation and charge transport disposed on the supporting substrate, the single layer photoreceptor comprising a binder containing a polyhedral oligomeric silsesquioxane; a cross-linking agent; a charge component; an electron transport component; and a charge generating component.

23 Claims, 1 Drawing Sheet

OTHER PUBLICATIONS

Jianli Wang, Zhibin Ye, and Helen Joly, Synthesis and Characterization of Hyperbranched Polyethylenes Tethered with Polyhedral Oligomeric Silsesquioxane (POSS) Nanoparticles by Chain Walking Ethylene Copolymerization with Acryloisobutyl-POSS, Jul. 28, 2007, *Macromolecules* 2007, 40, 6150-6163.

* cited by examiner

IMAGING MEMBERS

TECHNICAL FIELD

The present disclosure relates to imaging members and more particularly relates to single layer electrophotographic photoreceptors.

BACKGROUND

Electrophotographic imaging members, i.e., photoreceptors, typically include a photoconductive layer formed on an electrically conductive substrate. The photoconductive layer is an insulator in the dark so that electric charges are retained on its surface. Upon exposure to light, the charge is dissipated. A latent image is formed on the photoreceptor by first uniformly depositing electric charges over the surface of the photoconductive layer by one of any suitable means known in the art. The photoconductive layer functions as a charge storage capacitor with charge on its free surface and an equal charge of opposite polarity (the counter charge) on the conductive substrate. A light image is then projected onto the photoconductive layer. On those portions of the photoconductive layer that are exposed to light, the electric charge is conducted through the layer reducing the surface charge. The portions of the surface of the photoconductor not exposed to light retain their surface charge. The quantity of electric charge at any particular area of the photoconductive surface is inversely related to the illumination incident thereon, thus forming an electrostatic latent image.

The photo-induced discharge of the photoconductive layer requires that the layer photogenerate conductive charge and transport this charge through the layer thereby neutralizing the charge on the surface. Two types of photoreceptor structures have been employed: multilayer structures wherein separate layers perform the functions of charge generation and charge transport, respectively, reference, for example, U.S. Pat. Nos. 6,824,940; 6,787,277; and 6,677,909, the disclosures of each of which are totally incorporated by reference herein; and single layer structures in which photoconductors perform both charge generation and charge transport functions. These layers are formed on an electrically conductive substrate and may include an optional charge blocking layer and an adhesive layer between the conductive substrate and the photoconductive layer or layers. Additionally, the substrate may comprise a non-conducting mechanical support with a conductive surface. Other layers for providing special functions such as incoherent reflection of laser light, dot patterns for pictorial imaging, or subbing layers to provide chemical sealing and/or a smooth coating surface may also be employed.

One problem encountered with multilayered photoreceptors comprising a charge generating layer and the charge transport layer is that the thickness of the charge transport layer, which is normally the outermost layer, tends to become thinner during image cycling. This change in thickness causes changes in the electrical properties of the photoreceptor. Thus, in order to maintain image quality, complex and sophisticated electronic equipment is necessary in the imaging machine to compensate for the electrical changes. This increases the complexity of the machine, cost of the machine, size of the footprint occupied by the machine, and the like. Without proper compensation of the changing electrical properties of the photoreceptor during cycling, the quality of the images formed degrades due to spreading of the charge pattern on the surface of the imaging member and a decline in image resolution. High quality images are essential for digital copiers, duplicators, printers, and facsimile machines, particularly laser exposure machines that demand high resolutions images.

To achieve long life in conventional multilayer photoreceptors, several advanced concepts such as protective overcoat and wear resistant fillers in the charge transport layer have been pursued.

Alternatively, owing to their top-photogeneration mechanism, a long operating life is also feasible using single layer organic photoreceptors, with thicknesses of, for example, about 25 micrometers to about 40 micrometers. Another method of extending photoreceptor life is by using a thick one layer device, typically based on organic materials.

The majority of single layer organic photoreceptors generally comprise thermoplastic binders. Typically, a single layer organic photoreceptor comprises a photogenerating pigment, a thermoplastic binder, and hole and electron transport materials. Single layer organic photoreceptors have many advantages over multilayer photoreceptors in manufacturing costs, total cost of ownership, environmental friendliness, and print quality. The photogeneration mechanism is at the top or near the top of the photoreceptor surface, and therefore the photoreceptor is less prone to problems or variants associated with substrate related and thickness dependent photoelectrical properties. Top photogeneration also allows thick devices to be implemented as dictated by constraints of photoinduced discharge properties.

U.S. Pat. No. 6,656,650 of Liang-Bih Lin, Helen R. Cherniack, John S. Chambers, Anna M. Main, Huoy-Jen Yuh, Cindy C. Chen, James M. Duff, Timothy P. Bender describes in the Abstract thereof a member including, for example, a supporting layer and a single photogenerating layer, the photogenerating layer comprising particles including hydroxygallium phthalocyanine phthalocyanine Type V, x polymorph metal free phthalocyanine, or chlorogallium phthalocyanine dispersed in a matrix comprising an arylamine hole transporter and an electron transporter selected from the group consisting of N,N'bis(1,2-dimethylpropyl)-1,4,5,8-naphthalenetetracarboxylic diimide, 1,1'-dioxo-2-(4-methylphenyl)-6-phenyl-4-(dicyanomethylidene)thiopyran, and a quinone selected from the group consisting of carboxybenzylhaphthaquinone, and tetra (t-butyl) diphenoquinone, and mixtures thereof, and submicrometer size polytetrafluroethylene particles, and a film forming binder.

U.S. Pat. No. 5,370,953 describes in the Abstract thereof an electrophotosensitive material comprising a conductive substrate, a photosensitive layer formed on the conductive substrate and, if necessary, a surface protective layer formed on the photosensitive layer, wherein an oxadiazole derivative expressed in a general formula (I):

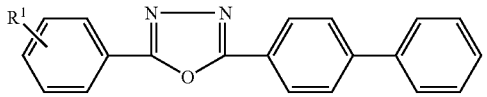

(I)

where $R^1$ denotes an alkyl group, is contained as an electron transfer substance on the photosensitive layer and/or surface protective layer. This photosensitive material enhances the electron transfer capability, and hence the sensitivity is improved. At the same time, the residual potential of the photosensitive material is lowered, and the stability and durability against repeated exposures are enhanced.

U.S. Pat. No. 5,336,577 describes in the Abstract a thick organic ambipolar layer on a photoresponsive device is simultaneously capable of charge generation and charge transport. In particular, the organic photoresponsive layer contains an electron transport material such as a fluorenylidene malonitrile derivative and a hole transport material such as a dihydroxy tetraphenyl benzadine containing polymer. These may be complexed to provide photoresponsivity, and/or a photoresponsive pigment or dye may also be included.

U.S. Pat. No. 5,700,614 describes in the Abstract cyclopentadiene derivative compounds, and an electrophotographic photoconductor comprising one cyclopentadiene derivative compound are disclosed. The cyclopentadiene derivative compounds are useful for use in a photoconductive layer, and readily soluble in a binder resin. The electrophotographic photoconductor can be prepared by using a simple, effective production method. The electrophotographic photoconductor comprising one cyclopentadiene derivative compound provides a good light sensitivity and high durability.

U.S. Pat. No. 5,968,696 describes in the Abstract a single-layer binder comprising a synthetic resin binder and a phthalocyanine pigment dispersed therein modified so as to reduce the content of the phthalocyanine pigment while maintaining or further improving the sensitivity of the binder. A coating material comprising a synthetic resin binder comprising as a constituent component a polyester resin containing halogen atoms, e.g., chlorine or bromine, and a phthalocyanine pigment dispersed in the binder is applied to a conductive base to produce an electrophotographic binder.

The disclosures of each of the foregoing U.S. Patents are each incorporated herein by reference in their entireties. The appropriate components and process aspects of the each of the foregoing U.S. Patents may be selected for the present invention in embodiments thereof.

There remains a need for a single layer electrophotographic imaging member having a long and robust service life. As employed herein, the expression "single layer photogenerating imaging member (or layer)" is defined as a single electrophotographically active layer capable of retaining an electrostatic charge in the dark during electrostatic charging, imagewise exposure, and image development. Further, there remains a need for an electrophotographic imaging member having a tough, abrasion resistant durable surface for high quality imaging while simultaneously achieving very low total cost of ownership and unit manufacturing cost.

SUMMARY

Disclosed are imaging members comprising a substrate; a single layer photoreceptor for both charge generation and charge transport disposed on the substrate, the single layer photoreceptor comprising a binder containing a polyhedral oligomeric silsesquioxane; a cross-linking agent; a charge component; an electron transport component; and a charge generating component, having many of the advantages illustrated herein, such as imaging members having materials that are compatible, imaging members comprising a cross-linked network, and imaging members wherein the photoconducting members possess, for example, excellent wear rates such as possessing an about 20% to about 30% improvement in wear rate over a standard drum. Further, in short (about 5,000 to about 10,000) cyclic tests, a stable device is provided. Further disclosed are imaging members comprising POSS (polyhedral oligomeric silsesquioxane) single layer photoreceptors providing long life electrophotographic imaging systems, viable devices for high quality imaging while simultaneously achieving very low total cost of ownership and unit manufacturing cost.

Aspects illustrated herein relate to imaging members comprising a substrate; a single layer photoreceptor for both charge generation and charge transport disposed on the substrate, the single layer photoreceptor comprising a binder comprising as a constituent thereof a polyhedral oligomeric silsesquioxane; a cross-linking agent; a hole transport component; an electron transport component; and a charge generating pigment. Described herein are, for example, single layer photoreceptors including photoreceptors having polyhedral oligomeric silsesquioxanes (POSS) possessing vinyl functionality incorporated into a cross-linkable single layer photoreceptor.

The imaging member may be imaged by depositing a uniform electrostatic charge on the imaging member, exposing the imaging member to activating radiation in image configuration to form an electrostatic latent image, and developing the latent image with electrostatically attractable marking particles to form a toner image in conformance to the latent image. Further aspects illustrated herein relate to an imaging method comprising forming an electrostatic latent image on an imaging member comprising a substrate; a single layer photoreceptor for both charge generation and charge transport disposed on the substrate, the single layer photoreceptor comprising a binder comprising as a constituent thereof a polyhedral oligomeric silsesquioxane; a cross-linking agent; a hole transport component; an electron transport component; and a charge generating pigment; developing the image with a toner composition; transferring the image to a substrate; and permanently affixing the image to the substrate.

These and other features and advantages of the invention will be more fully understood from the following description of certain specific embodiments of the invention taken together with the accompanying drawing.

DESCRIPTION

Figure 1:
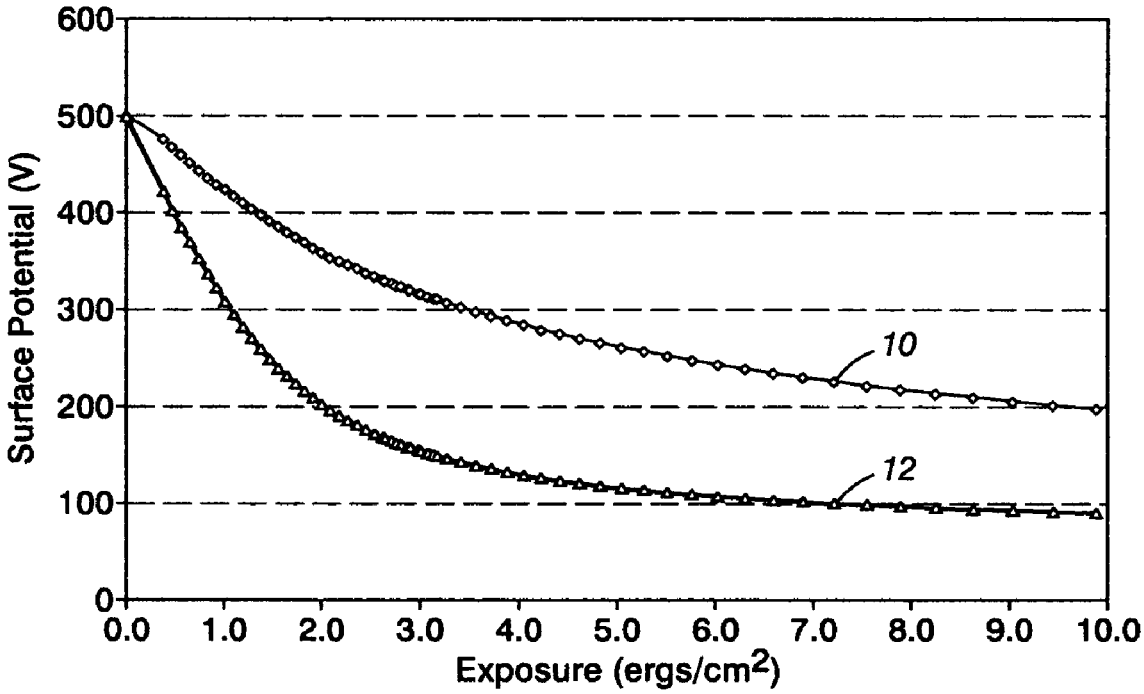
FIG. 1 is a graph showing photoinduced discharged characteristics curves for a single layer POSS photoreceptor device as described herein at positive and negative charging modes.

The single layer photogenerating imaging members illustrated herein comprise a single electrophotographically active layer capable of retaining an electrostatic charge in the dark during electrostatic charging, imagewise exposure and image development. Thus, the single layer photoreceptor is unlike a multilayered photoreceptor which has at least two electrophotographically active layers including at least one charge generating layer and at least one separate charge transport layer. In other words, the single layer electrophotographic imaging member illustrated herein is free of any charge generating layer between the supporting layer and the single photogenerating layer. Moreover, the single photogenerating layer imaging member illustrated herein may also be free of any charge blocking layer or any anti-plywood layer between the supporting layer and the single photogenerating layer.

Imaging members described herein comprise a single layer photoreceptor for both charge generation and charge transport disposed on a supporting substrate, the single layer photoreceptor comprising a binder comprising as a constituent thereof a polyhedral oligomeric silsesquioxane; a cross-linking agent; a charge (hole transport) component; an electron transport component; and a charge generating component such as a charge generating pigment. For example, the single layer photoreceptors include photoreceptors having polyhedral oligomeric silsesquioxanes (POSS) possessing vinyl functionality incorporated into a cross-linkable single layer photoreceptor. Illustrative examples of binder materials that can be selected for the single layer photoreceptor are selected from the group consisting of thermoplastic binders, copolymers of vinyl chloride, vinyl acetate and hydroxyl and/or acid containing monomers, polyesters, polyvinyl butyrals, polycarbonates, polystyrene-β-polyvinyl pyridine, and polyvinyl formals, and mixtures thereof. Illustrative examples of polymeric binder materials that can be selected for the single layer photoreceptor are as indicated herein and include those polymers as disclosed in U.S. Pat. No. 3,121,006, the disclosure of which is totally incorporated herein by reference. In general, the effective amount of binder that is utilized in the single layer photoreceptor ranges from about 0 to about 95 percent by weight, and more specifically from about 25 to about 60 percent by weight of the photoreceptor single layer.

The polyhedral oligomeric silsesquioxanes (POSS) used herein comprise silica-polymer hybrids having phase sizes on the nanometer scale. The particle diameter of the POSS molecules is, for example, from about 0.7 to about 30 angstroms. The POSS structures can be functionalized with a wide variety of groups providing a range of POSS monomers and such structural features provide a framework for enhancing mechanical strength and film integrity. The nature of the functional group determines compatibility with the polymer matrix. POSS has the general cage structure (1)

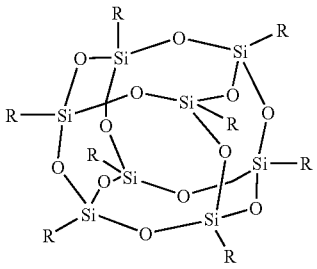

wherein the R group can be simple alkyl, alkenyl, cycloalkyl or aryl, or reactive/polymerizable groups such as arylic, α-olefin, styrene, epoxide, carboxylic acid, isocyanate, amine, alcohol, silane, and mixtures thereof. The functionalized POSS structures can be copolymerized with a range of monomers, or grafted onto polymer chains. In specific embodiments, the R group is selected from the group consisting of allyl, hydrogen, propyl methacryl, ethylnorbornenyl, vinylphenyl, methyl propionate, ethyl undecanoate, hydroxyl, glycidyl, 3-chloropropyl, 3-cyanopropyl, vinyl, diphenylphosphinoethyl, and mixtures thereof.

In specific embodiments, the POSS comprises vinyl polyhedral oligomeric silsesquioxane having the structure (2)

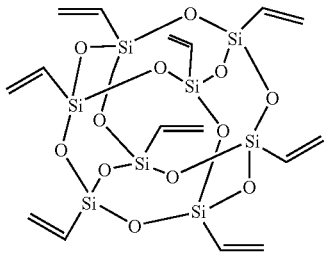

The components may be provided for example, in a weight ratio of the combined weight of POSS and cross-linking agent to the combined weight of binder, hole transport and electron transport components of, for example, about 1:90 to about 30:70 or about 5:95 to about 10:90. The weight ratio of charge generating component to all other components comprising the single layer photoreceptor may be, for example, about 0.01 to about 0.1 or about 0.03 to about 0.06. The weight ratio between POSS and cross-linking gent may be, for example, about 10:90 to about 90:10. Further, the weight ratio between the total of hole and electron transport components to binder may be provided at about 0.2 to about 0.9 or about 0.35 to about 0.55, and the weight ratio between hole and electron transport components may be, for example, about 0.2 to about 0.9 or about 0.4 to about 0.6.

Illustrative cross-linking agents for the cross-linked single layer photoreceptor include an organosilane (3)

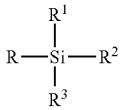

wherein R is alkyl or aryl, and $R^1$, $R^2$, and $R^3$ are independently selected from the group consisting of alkoxy, aryloxy, acyloxy, halide, cyano, amino, and mixtures thereof.

A specific cross-linking agent comprises phenyltris(dimethylsiloxy) silane having the structure (4)

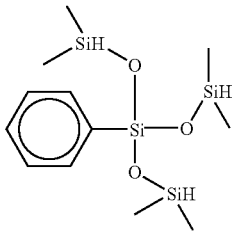

The charge component comprises, for example, a hole transport component selected, for example, from the group consisting of arylamines, pyrazolines, hydrazones, enamines, and mixtures thereof. Typical charge transporting small molecules include, for example, pyrazolines such as 1-phenyl-3-(4'-diethylamino styryl)-4-(4"-diethylamino phenyl)pyrazoline, diamines such as N,N'-diphenyl-N,N'-bis(3-methylphenyl)-(1,1'-biphenyl)4,4'-diamine, hydrazones such as N-phenyl-N-methyl-3-(9-ethyl)carbazyl hydrazone and 4-diethyl amino benzaldehyde-1,2-diphenyl hydrazone, and oxadiazoles such as 2,5-bis-(4-N,N'-diethylaminophenyl)-1,2,4-oxadiazole, stilbenes, and the like. Alternate hole transport molecules may be used such as, but not limited to, for example, N,N'-bis(3,4-dimethylphenyl)-N"(1-biphenyl) amine (MPPA), having the structure (5)

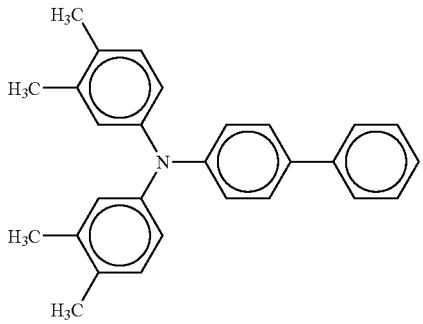

and N,N'-diphenyl-N'N'-bis(alkylphenyl)-1,1-biphenyl-4,4'-diamine (TPD), having the structure (6)

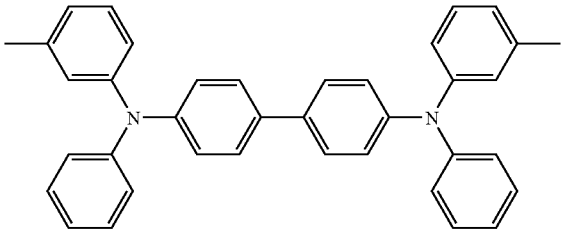

Illustrative of suitable electron transport materials include an electron transporting small molecule such as a fluorenylidene malonitrile derivative, specifically 4-n-butoxycarbonyl-9-fluorenylidene) malonitrile, N,N'bis(1,2-dimethylpropyl)-1,4,5,8-naphthalenetetracarboxylic diimide, or butylcarboxlfluorenone malonitrile having the structure (7)

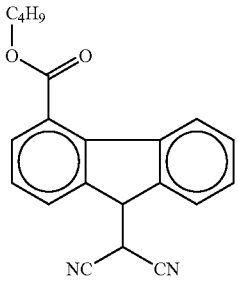

among others.

Numerous other suitable hole transporting small molecules and polymeric binders and electron transporting small molecules are also known and may be useful in the present photoreceptors. Representative such materials are disclosed in U.S. Pat. No. 4,515,882, the disclosure of which is hereby totally incorporated by reference herein.

Illustrative examples of charge generating materials include known photogenerating pigments, such as metal phthalocyanines, metal free phthalocyanines, alkylhydroxyl gallium phthalocyanine, hydroxygallium phthalocyanines, perylenes, especially bis(benzimidazo)perylene, titanyl phthalocyanines, and the like, and more specifically, vanadyl phthalocyanines, Type V hydroxygallium phthalocyanines, and inorganic components such as selenium, selenium alloys, and trigonal selenium. The photogenerating pigment can be dispersed in a resin binder which binder may be present in various suitable amounts, for example from about 1 to about 50, and more specifically, from about 1 to about 10 weight percent and which may be selected from a number of known polymers such as poly(vinylbutyral), poly(vinylcarbazole), polyesters, polycarbonates, poly(vinylchloride), polyacrylates and methacrylates, copolymers of vinyl chloride and vinyl acetate, phenolic resins, polyurethanes, poly(vinylalcohol), polyacrylonitrile, polystyrene, and the like. It is desirous to select solvents suitable for the charge generating component that do not substantially disturb or adversely affect the other components of the single layer photoreceptor. Illustrative of solvents that can be selected for the pigment dispersion include ketones, alcohols, aromatic hydrocarbons, halogenated aliphatic hydrocarbons, ethers, amines, amides, esters, and the like. Specific examples include cyclohexanone, acetone, methyl ethyl ketone, methanol, ethanol, butanol, amyl alcohol, toluene, xylene, chlorobenzene, carbon tetrachloride, chloroform, methyl chloride, trichlorethylene, tetrahydrofuran, dioxane, diethyl ether, dimethyl formamide, dimethyl acetamide, butyl acetate, ethyl acetate, methoxyethyl acetate, and the like.

Any suitable substrate may be employed in the imaging members illustrated herein. The substrate may be opaque or substantially transparent, and may comprise any suitable material having the requisite mechanical properties. Illustrative examples of substrate materials selected for the present imaging members, and which substrates can be opaque or substantially transparent, include, but are not limited to, insulating material including inorganic or organic polymeric materials, such as MYLAR®, a commercially available polymer, MYLAR® containing titanium, a layer of an organic or inorganic material having a semiconductive surface layer, such as indium tin oxide, or aluminum arranged thereon, or a conductive material such as aluminum, chromium, nickel, brass, steel, alloys, and the like. The substrate may be flexible, seamless, or rigid, and may have a number of many different configurations, such as for example, a plate, a cylindrical drum, a scroll, an endless flexible belt, and the like. In embodiments, the substrate is in the form of a seamless flexible belt. The support can also be a conductive non-metallic drum, such as extruded carbon black loaded polymeric binder. In some situations, it may be desirable to coat on the back of the substrate, particularly when the substrate is a flexible organic polymeric material, an anticurl layer, such as for example, polycarbonate materials commercially available as MAKROLON®.

The thickness of the substrate layer depends on many factors, including economical considerations, thus this layer may be of substantial thickness, for example over 3,000 microns, or of minimum thickness providing there are no significant adverse effects on the member. In embodiments, the thickness of the supporting substrate is from about 75 microns to about 300 microns.

Intermediate thin layers functioning as hole and/or electron blocking and/or adhesive layers are optional. When used, such layers may include the hydrolyzed product of γ-aminopropyltriethoxy silane, poly 2-hydroxyethylmethacrylate, and other related and non-related hydroxylic materials, and any other suitable hole and/or electron blocking layer compositions. Suitable adhesive layers include components selected from the group consisting of, for example, film-forming polymers, polyester, polyvinylbutyral, polyvinylpyrrolidone, polyurethane, polymethyl methacrylate, and mixtures thereof. The adhesive layer composition can be DuPont's 49000™ polyester, Goodyear's Vitel™ resins (PE-100 and 200, and the like) or any other suitable adhesive composition which does not interfere with xerographic cycling.

The coating of the single layer photoreceptor onto the substrate can be accomplished in any suitable fashion such as spray, dip or wire-bar methods such that the final dry thickness of the single layer photoreceptor is, for example, about 1 to about 50 micrometers or about 15 to about 25 micrometers after being coated onto a substrate and dried at, for example, about 40° C. to about 150° C. for about 15 to about 90 minutes.

Optionally, the single layer photoreceptor can be coated onto a thin hole blocking layer, an optional adhesive layer, an optional surface protective layer, or a combination thereof, but these thin layers are not needed to obtain an electrically functional photoreceptor for most environments.

The optional blocking layer for positively charged photoreceptors allow holes from the imaging surface of the photoreceptor to migrate toward the conductive substrate. For negatively-charged photoreceptors, any suitable hole blocking layer capable of forming a barrier to prevent hole injection may be utilized. The hole blocking layer may include polymers such as polyvinylbutyral, epoxy resins, polyesters, polysiloxanes, polyamides, polyurethanes and the like, or may be nitrogen-containing siloxanes or nitrogen-containing titanium compounds such as trimethoxysilyl propyl ethylene diamine, N-beta-(aminoethyl) gamma-amino-propyl trimethoxy silane, isopropyl 4-aminobenzene sulfonyl, di(dodecylbenzene sulfonyl) titanate, isopropyl di(4-aminobenzoyl)isostearoyl titanate, isopropyl tri(N-ethylamino-ethylamino) titanate, isopropyl trianthranil titanate, isopropyl tri(N,N-dimethyl-ethylamino)-titanate, titanium-4-amino benzene sulfonate oxyacetate, titanium 4-aminobenzoate isostearate oxyacetate, $[H_2N(CH_2)_4]CH_3Si(OCH_3)_2$ (delta-aminobutyl methyl dimethoxy silane), $[H_2N(CH_2)_3]CH_3Si(OCH_3)_2$ (gamma-aminopropyl) methyl dimethoxy silane), and $[H_2N(CH_2)_3]Si(OCH_3)_3$ (gamma-aminopropyl trimethoxy silane) as disclosed in U.S. Pat. Nos. 4,338,387, 4,286,033, and 4,291,110, the disclosures of each of which are herein totally incorporated by reference). The hole blocking layer may also include delta-aminobutylmethyl diethoxy silane, gamma-aminopropyl methyl diethoxy silane, and gamma-aminopropyl triethoxy silane.

The blocking layer is continuous and has a thickness of for example less than about 0.5 micrometer or between about 0.005 micrometer and about 0.3 micrometer, or between about 0.03 and about 0.06 micrometer. The blocking layer may be applied by any suitable conventional technique such as spraying, dip coating, draw bar coating, gravure coating, silk screening, air knife coating, reverse roll coating, vacuum deposition, chemical treatment, and the like. For convenience in obtaining thin layers, the blocking layer may be applied in the form of a dilute solution, with the solvent being removed after deposition of the coating by conventional techniques such as by air convection and vacuum heating and the like.

Intermediate layers between the blocking layer and the single layer photoreceptor may be desired to promote adhesion. If such layers are utilized, they preferably have a dry thickness between about 0.01 micrometer to about 0.3 micrometer, or about 0.05 to about 0.2 micrometer. Typical adhesive layers include film-forming polymers such as polyester, DuPont 49000™ resin (available from E.I. DuPont de Nemours & Co.), Vitel™ PE-100 (available from Goodyear Rubber & Tire Co.), polyvinylbutyral, polyvinylpyrrolidone, polyurethane, polymethyl methacrylate, and the like.

Also included as part of the present disclosure are methods of imaging and printing with the imaging members illustrated herein. These methods generally involve the formation of an electrostatic latent image on the imaging member, followed by developing the image with a toner composition comprised, for example, of thermoplastic resin, colorant, such as pigment, charge additive, and surface additives, reference U.S. Pat. Nos. 4,560,635, 4,298,697, and 4,338,390, the disclosures of which are totally incorporated herein by reference, subsequently transferring the image to a suitable substrate, and permanently affixing the image thereof. In those environments wherein the device is to be used in a printing mode, the imaging method involves the same aforementioned sequence with the exception that the exposure step can be accomplished with a laser device or image bar.

The following Examples are being submitted to illustrate embodiments of the imaging members disclosed herein. These Examples are intended to be illustrative only and are not intended to limit the scope of the present disclosure. Parts and percentages are by weight unless otherwise indicated.

EXAMPLE

A sample imaging member preparation was conducted in two phases as follows. First a pigment, Type V hydroxygallium phthalocyanine, was mixed with a polycarbonate (PCZ400™ polycarbonate, commercially available from Mitsubishi Chemical), at a 50:50 weight ratio in tetrahydrofuran (THF) at about 10% to about 12% solids and milled with $ZrO_2$ beads for about 2 to 3 days, where the mill end point was determined by measured particle size compared against previous results measured by light scattering or sedimentation method to about 100 to about 400 nanometers. The mill base was then filtered with a 20 micrometer Nylon filter.

Separately, 6.5 grams MPPA (N,N'-bis(3,4-dimethylphenyl)-N"(1-biphenyl)amine hole transport component, 6.5 grams (TPD) N,N'-diphenyl-N,N'-bis(alkylphenyl)-1,1-biphenyl-4,4'-diamine hole transport molecules, 10 grams butylcarboxlfluorenone malonitrile electron transport component, 24.8 grams additional PCZ400, 5 grams additional vinyl-POSS monomer (OL1170 available from Hybrid Plastics) and 7.5 grams hydridosilane (available from Gelest) were mixed to dissolve in 120 grams of tetrahydrofuran and toluene solvent to provide a composition comprising PCZ400/TPD/MPPA/ETM/OL117/lsilane at a weight ratio of 50% PCZ400, 13% TPD, 13% MPPA, 20% ETM, 10% OL117, and 15% silane, and a total solids content of about 26% to about 27%.

The pigment dispersion comprising Type V hydroxygallium phthalocyanine was then incorporated into the solution in an amount of about 1.5% to about 2% weight ratio pigment dispersion against the total solids.

Finally, a small quantity of platinum carbonyl cyclovinylmethylsiloxane complex (Gelest) catalyst was added for subsequent coatings.

Regular A40S Alloy substrates were used. Four example substrates were coated onto sample A40S Alloy substrates as shown in Table 1. Devices of about 15 to about 25 micrometers in thickness were fabricated by dip coating. The coated substrates were cured under curing conditions of about 140° C. for about 30 to about 35 minutes.

The photoreceptors were examined for electrophotographic properties. Representative photoinduced discharge and electrical properties for the Examples are shown in Table 1 (Examples 1-4) and FIG. 1 (Example 5).

TABLE 1

| Example # | Formulation POSS/Silane/OHGaPC | Thickness (μm) | dV/dX (Pos) (V/ergs/cm$^2$) | dV/dX (neg) (V/ergs/cm$^2$) | Verase (v) | Dark Decay, (V/s) |
|---|---|---|---|---|---|---|
| 1 | 10/15/1.2 | 14 | 160 | 70 | 40 | 33 |
| 2 | 10/15/1.2 | 18 | 190 | 82 | 44 | 72 |
| 3 | 10/10/1.5 | 19 | 208 | 78 | 43 | 64 |
| 4 | 10/15/1.8 | 20 | 220 | 83 | 46 | 49 |

In Table 1, Verase refers to the surface potential of an imaging member after exposure to erase light during the electrophotographic process and dark decay refers to the decrease in surface potential of an imaging member in the dark.

Visual solvent dripping testing using tetrahydrofuran was performed on the dry films and no apparent delamination was found. There was also no difference in electrophotographic performance for devices whether or not the devices have or have not been exposed to tetrahydrofuran. The above devices were electrically tested with a cyclic scanner set to obtain 100 charge-erase cycles immediately followed by an additional 100 cycles, sequences at 1 charge-erase cycle and 1 charge-expose-erase cycle, wherein the light intensity was incrementally increased with cycling to produce a photoinduced discharge curve from which the photosensitivity was measured. The scanner was equipped with a sco corotron (5 centimeters wide) set to deposit about 100 nanocoulombs/cm$^2$ of charge on the surface of the drum devices. The exposure light intensity was incrementally increased by means of regulating a series of neutral density filters, and the exposure wavelength was controlled by a bandfilter at 780+/−5 nanometers. The exposure light source was a 1000 watt Xenon arc lamp white light source.

The drum was rotated at a speed of 61 rpm to produce a surface speed of 25 inches/second or a cycle time of about one second. The entire xerographic simulation was carried out in an environmentally controlled light tight chamber at ambient conditions (35 percent relative humidity and about 20° C.).

Example 5. A single layer POSS device having the formulation HOGaPC/PCZ/TPDIMPPAIBCFM/Vinyl-POSS/silane at a ratio of 1.2/50/13/13/20/10/15 and a thickness of about 20 micrometers was coated onto a A40S Alloy substrate. The electrical properties were tested as described above. FIG. 1 shows surface potential (V) (y-axis) versus exposure (ergs/cm2) (x-axis) for the single layer POSS device having the formulation of Example 5 at positive charging mode (line 10) and negative charging mode (line 12).

The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others.

What is claimed is:

1. An imaging member comprising:

a substrate;

a single layer photoreceptor for both charge generation and charge transport disposed on the substrate, the single layer photoreceptor comprising a binder containing a polyhedral oligomeric silsesquioxane; a cross-linking agent; a charge component; an electron transport component; and a charge generating component;

wherein the polyhedral oligomeric silsesquioxane is of the formula:

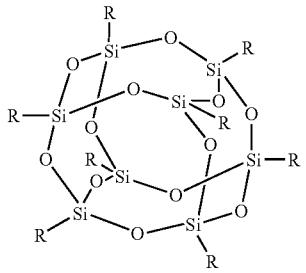

wherein R is selected from the group consisting of allyl, hydrogen, propyl methacryl, ethylnorbornenyl, vinylphenyl, methyl propionate, ethyl undecanoate, hydroxyl, glycidyl, 3-chloropropyl, 3-cyanopropyl, vinyl, diphenylphosphinoethyl, and mixtures thereof.

2. An imaging member comprising:

a substrate;

a single layer photoreceptor for both charge generation and charge transport disposed on the substrate, the single layer photoreceptor comprising a binder containing a polyhedral oligomeric silsequioxane; a cross-linking agent; a charge component; and electron transport component; and a charge generating component;

wherein the polyhedral oligomeric silsesquioxane is of the formula;

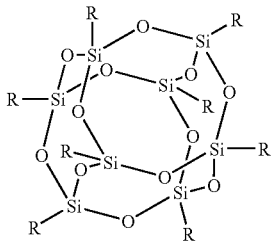

wherein R is selected from the group consisting of alkyl, alkenyl, cycloalkyl, aryl, arylic, α-olefin, styrene, epoxide, carboxylic acid, isocyanate, amine, alcohol, silane, or mixtures thereof.

3. The imaging member of claim 1, wherein the polyhedral oligomeric silsesquioxane is vinyl polyhedral oligomeric silsesquioxane.

4. The imaging member of claim 1, wherein the polyhedral oligomeric silsesquioxane is a nanostructured material having an average particle diameter of about 0.7 to about 30 angstroms.

5. The imaging member of claim 1, wherein the binder is selected from the group consisting of copolymers of vinyl chloride, vinyl acetate and hydroxyl and/or acid containing monomers, polyesters, polyvinyl butyrals, polycarbonates, polystyrene-β-polyvinyl pyridine, polyvinyl formals, and mixtures thereof.

6. The imaging member of claim 1, wherein the cross-linking agent is an organosilane of the formula:

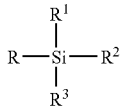

wherein R is alkyl or aryl, and $R^1$, $R^2$, and $R^3$ are independently selected from the group consisting of alkoxy, aryloxy, acyloxy, halide, cyano, amino, and mixtures, thereof.

7. The imaging member of claim 1, wherein the cross-linking agent is phenyltris(dimethylsioxy)silane.

8. The imaging member of claim 1, wherein the charge component is a hole transport component selected from the group consisting of arylamines, pyrazolines, hydrazones, enamines, and mixtures thereof.

9. The imaging member of claim 1, wherein the charge component is a hole transport component selected from the group consisting of N,N'-bis(3,4-dimethylphenyl)-N"(1-biphenyl) amine, N,N'-diphenyl-N'N'-bis(alkylphenyl)-1,1-biphenyl-4,4'-diamine, and mixtures thereof.

10. The imaging member of claim 1, wherein the electron transport component is selected from the group consisting of fluorenylidene malonitrile derivatives, 4-n-butoxycarbonyl-9-fluorenylidene) malonitrile, N,N'bis(1,2-dimethylpropyl)-1,4,5,8-naphthalenetetracarboxylic diimide, butylcarboxlfluorenone malonitrile, and mixtures thereof.

11. The imaging member of claim 1, wherein the charge generating component is selected from the group consisting of metal phthalocyanines, metal free phthialocyanines, alkylhydroxyl gallium phthalocyanine, hydroxygallium phthalocyanines, perylenes, bis(benzimidazo)perylene, titanyl phthalocyanines, vanadyl phthalocyanines, Type V hydroxygallium phthalocyanines, and inorganic charge generating components, selenium, selenium alloys, trigonal selenium, and mixtures thereof.

12. The imaging member of claim 1, further comprising:

a hole blocking layer, an adhesive layer, or a combination thereof.

13. The imaging member of claim 1, further comprising a hole blocking layer selected from the group consisting of polyvinylbutyral, epoxy resins, polyesters, polysiloxanes, polyamides, polyurethanes, nitrogen-containing siloxanes, nitrogen-containing titanium compounds, trimethoxysilyl propyl ethylene diamine, N-beta-(aminoethyl) gamma-amino-propyl trimethoxy silane, isopropyl 4-aminobenzene sulfonyl, di(dodecylbenzene sulfonyl) titanate, isopropyl di(4-aminobenzoyl)isostearoyl titanate, isopropyl tri(N-ethylamino-ethylamino) titanate, isopropyl trianthranil titanate, isopropyl tri(N,N-dimethyl-ethylamino)-titanate, titanium-4-amino benzene suffonate oxyacetate, titanium 4-aminobenzoate isostearate oxyacetate, $[H_2N(CH_2)_4]CH_3Si(OCH_3)_2$ (delta-aminobutyl methyl dimethoxy silane), $[H_2N(CH_2)_3]CH_3Si(OCH_3)_2$(gamma-aminopropyl) methyl dimethoxy silane), $[H_2N(CH_2)_3]Si(OCH_3)_3$ (gamma-aminopropyl trimethoxy silane), delta-aminobutylmethyl diethoxy silane, gamma-aminopropyl methyl diethoxy silane, gamma-aminopropyl triethoxy silane, and mixtures thereof.

14. The imaging member of claim 1, further comprising an adhesive layer selected from the group consisting of film-forming polymers, polyester, polyvinylbutyral, polyvinylpyrrolidone, polyurethane, polymethyl methacrylate, and mixtures thereof.

15. The imaging member of claim 1, wherein the single layer photoreceptor has a thickness of 15 to about 25 micrometers after drying.

16. The imaging member of claim 1, wherein a weight ratio of a combined weight of polyhedral oligomeric silsesquioxane and cross-linking agent to a combined weight of binder, charge component, and electron transport components is about 1:90 to about 30:70.

17. The imaging member of claim 1, wherein a weight ratio of a combined weight of polyhedral oligomeric silsesquioxane and cross-linking agent to a combined weight of binder, charge component, and electron transport components is about 5:95 to about 10:90.

18. The imaging member of claim 1, wherein a weight ratio of charge generating component to all other components comprising the single layer photoreceptor is about 0.01 to about 0.1.

19. The imaging member of claim 1, wherein a weight ratio of charge generating component to all other components comprising the single layer photoreceptor is about 0.03 to about 0.06.

20. The imaging member of claim 1, wherein a weight ratio of polyhedral oligomeric silsesquioxane and cross-linking agent is about 10:90 to about 90:10.

21. The imaging member of claim 1, wherein a weight ratio between a total of hole and electron transport components to binder is about 0.2 to about 0.9 and wherein a weight ratio between the charge component, and electron transport components is about 0.2 to about 0.9.

22. The imaging member of claim 1, wherein a weight ratio between a total of charge component and electron transport components to binder is about 0.35 to about 0.55 and wherein a weight ratio between the charge component and electron transport components is about 0.4 to about 0.6.

23. An imaging method comprising:

forming an electrostatic latent image on an imaging member comprising a substrate, a single layer photoreceptor for both charge generation and charge transport disposed on the substrate, the single layer photoreceptor comprising a binder containing a polyhedral oligomeric silsesquioxane, a cross-linking agent, a charge component, an electron transport component, and a charge generating component;

wherein the polyhedral oligomeric silsesquioxane is of the formula:

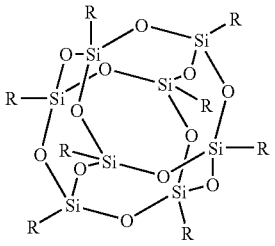

wherein R is selected from the group consisting of allyl, hydrogen, propyl methacryl, ethylnorbornenyl, vinylphenyl, methyl propionate, ethyl undecanoate, hydroxyl, glycidyl, 3-chloropropyl, 3-cyanopropyl, vinyl, diphenylphosphinoethyl, and mixtures thereof;

developing the image with a toner composition;

transferring the image to a substrate, and permanently affixing the image to the substrate.

* * * * *